US009433988B1

(12) United States Patent
Huang

(10) Patent No.: US 9,433,988 B1
(45) Date of Patent: Sep. 6, 2016

(54) PIPE BENDER

(71) Applicant: YUNG CHI INDUSTRY CO., LTD., Taichung (TW)

(72) Inventor: Wu-Sheng Huang, Taichung (TW)

(73) Assignee: Yung Chi Industry Co., Ltd., Taichung (TW)

( * ) Notice: Subject to any disclaimer, the term of this patent is extended or adjusted under 35 U.S.C. 154(b) by 0 days.

(21) Appl. No.: 14/721,657

(22) Filed: May 26, 2015

(51) Int. Cl.
*B21D 7/08* (2006.01)
*B21D 7/06* (2006.01)
*B21D 7/04* (2006.01)

(52) U.S. Cl.
CPC ..... *B21D 7/066* (2013.01); *B21D 7/04* (2013.01); *B21D 7/063* (2013.01)

(58) Field of Classification Search
CPC ..... B21D 7/066; B21D 7/063; B21D 7/04; B21D 7/06; B21D 7/022
USPC ..... 72/390.2, 389.9
See application file for complete search history.

(56) References Cited

U.S. PATENT DOCUMENTS 4,989,441 A * 2/1991 Wagner ..... B21D 7/063 72/213
5,761,950 A * 6/1998 Chiu ..... B21D 7/063 72/389.1
6,931,908 B1 * 8/2005 Mitson ..... B21D 7/04 72/213
7,412,867 B2 * 8/2008 Boulin ..... B21D 7/063 72/389.9
9,144,835 B2 * 9/2015 Houle ..... B21D 7/063
9,162,273 B1 * 10/2015 Chiu ..... B21D 7/06

* cited by examiner

*Primary Examiner* — David B Jones
(74) *Attorney, Agent, or Firm* — Wang Law Firm, Inc.

(57) ABSTRACT

A pipe bender includes: a body, a movable member, a return member, a stationary member, two adjustment members, two transverse positioning assemblies, two longitudinal positioning assemblies and a bending member. The movable member is disposed in the body, and an elastic member is disposed between the movable member and the body. A drive member and the return member are pivoted to the body, and the return member and the drive member are engaged with the rack of the body. The stationary member is fixed to the support portion of the body and arranged in a T-shaped manner with respect to the movable member. The two adjustment members are movably mounted at two ends of the stationary member to adjust a distance therebetween. A rotary block is fixed at the top of each of the adjustment members, and then the pipe bending member is mounted on the movable member.

12 Claims, 9 Drawing Sheets

PIPE BENDER

BACKGROUND OF THE INVENTION

1. Field of the Invention

The present invention relates to a pipe bender, and more particularly to a pipe bender capable of bending different sized pipes.

2. Description of the Prior Art

Manual pipe benders are not only complicated in structure but also difficult to operate. Conventional manual benders are either electrically or hydraulically driven, and needs to be operated by two hands.

One of the conventional manual pipe benders is a T-shaped structure formed by a longitudinally extending handle and a transversely extending fixing plate fixed on the handle. When in use, the pipe to be bent is pressed against two support members at two ends of the fixing plate, and then the handle is pushed to use a rack to push the pipe until it is bent.

The problem is that the distance between the two support members at two ends of the fixing plate is adjusted by eye based on the user's experience, or based on the scale on the fixing plate, so that the adjustment is time consuming. Furthermore, when the bending is done, a press portion should be used to push the rack back to its original position. However, the pipe bender needs to be operated by two hands, and the position of the press portion requires the user to hold the pipe bender with one hand and to press the press portion with another hand, which makes the operation inconvenient.

The present invention has arisen to mitigate and/or obviate the afore-described disadvantages.

SUMMARY OF THE INVENTION

The primary objective of the present invention is to provide a pipe bender which is provided with two adjustment members which are movable along the stationary member to adjust the distance therebetween and can be positioned with respect to the stationary member.

Another objective of the present invention is to provide a pipe bender which is provided with a return member, the return member is located at the rear of the body and adjacent to the gripping portion, when bending of the pipe is finished, the user can repeatedly press the return member with easy to return the movable member back to its original position.

Yet, another objective of the present invention is to provide a pipe bender, wherein the rack of the movable member has a relatively long length to increase the travel length of the movable member, so that the pipe can be bent 90 or 180 degrees.

To achieve the above objective, a pipe bender in accordance with the present invention comprises: a body, a movable member, a return member, a stationary member, two adjustment members, two transverse positioning assemblies, two longitudinal positioning assemblies and a bending member. The movable member is disposed in the body, and an elastic member has two ends fixed to the movable groove and the body, respectively. A drive member and the return member are pivoted to the interior of the body, and the return member has an engaging tooth and the drive member has a toothed portion engaged with the rack of the body. The stationary member is fixed to the support portion of the body and arranged in a T-shaped manner with respect to the movable member. The two adjustment members are movably mounted at two ends of the stationary member to adjust a distance therebeetween. A rotary block is fixed at the top of each of the adjustment members, and then the pipe bending member is mounted on the movable member.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
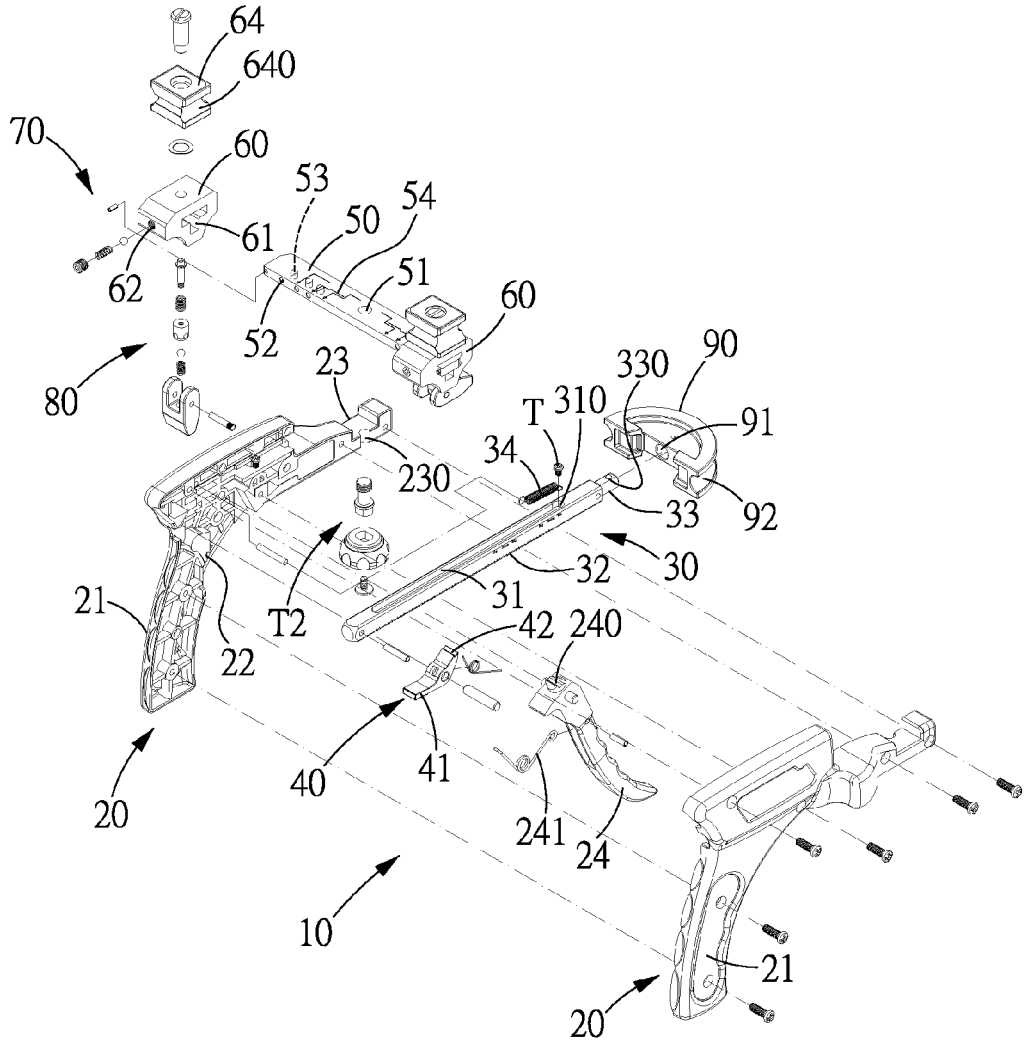
FIG. 1 is an exploded view of a pipe bender in accordance with the present invention.
Figure 2:
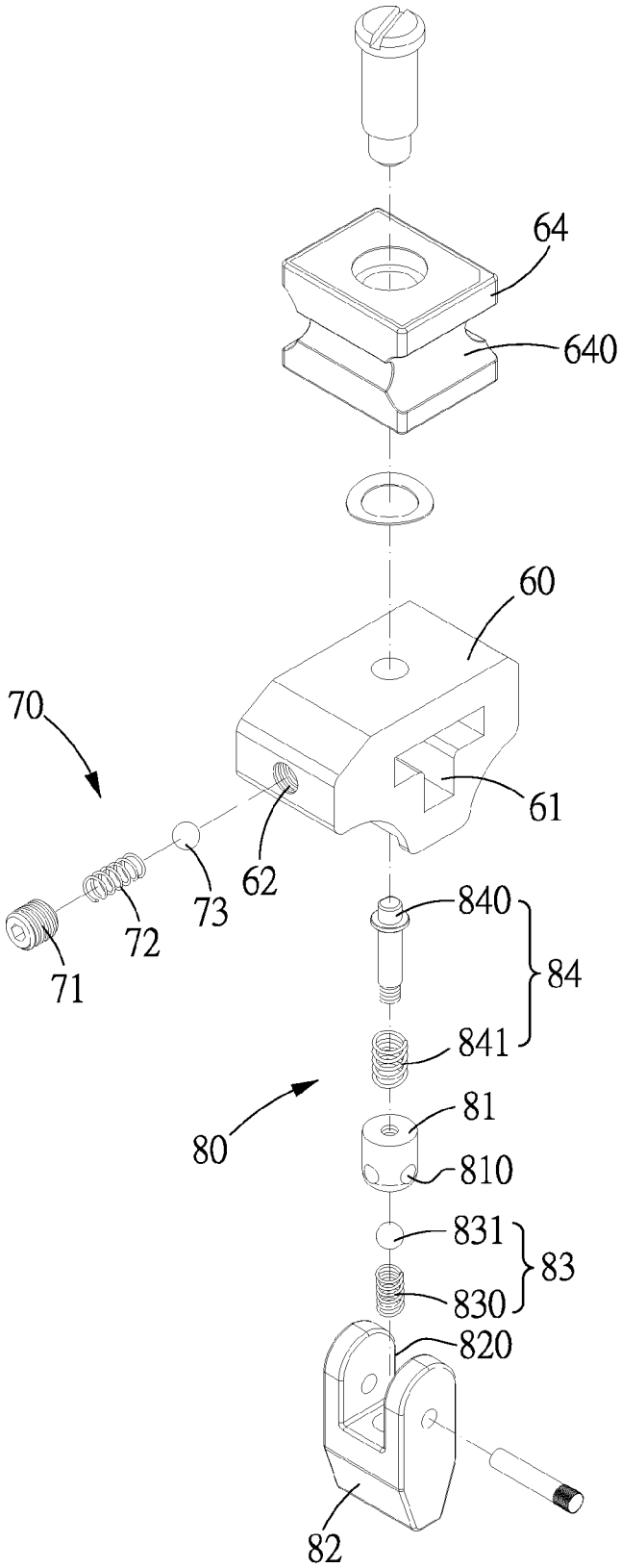
FIG. 2 is an exploded view of a part of the pipe bender in accordance with the present invention.
Figure 3:
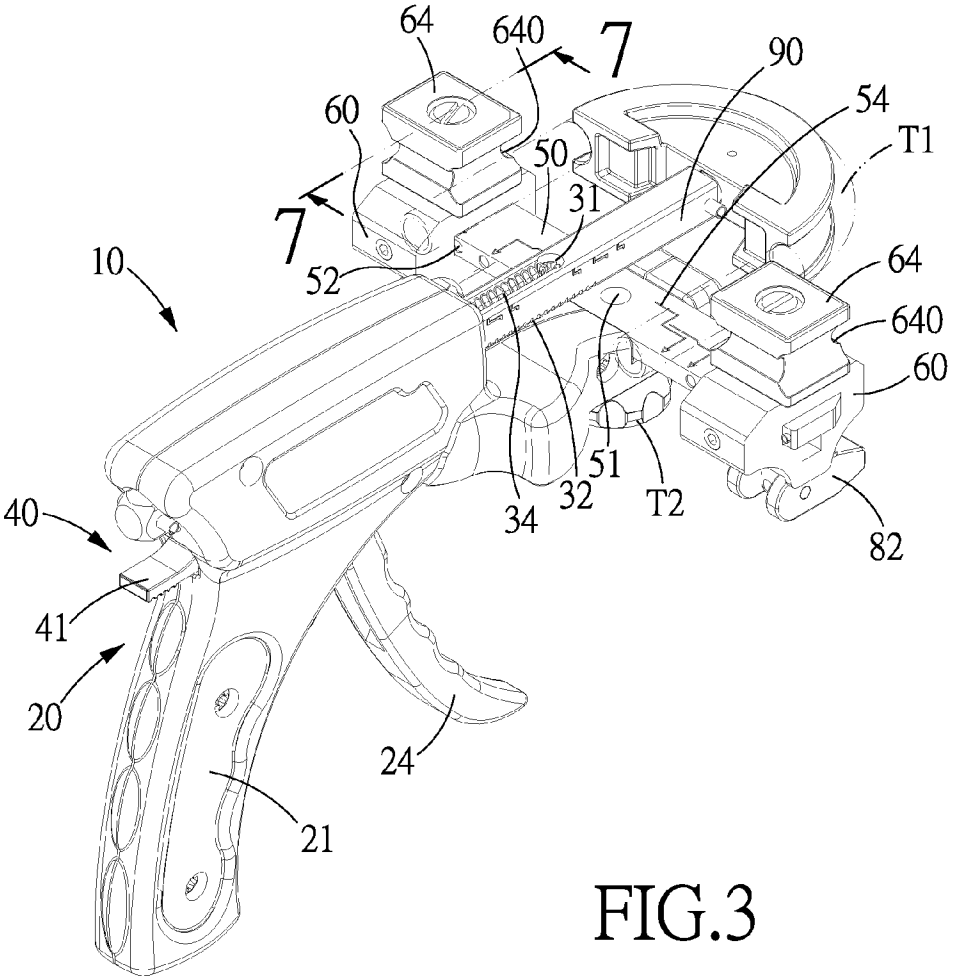
FIG. 3 is perspective view of the pipe bender in accordance with the present invention.

Referring to FIGS. 1-3, a pipe bender 10 in accordance with the present invention comprises: a body 20, a movable member 30, a return member 40, a stationary member 50, two adjustment members 60, two transverse positioning assemblies 70, two longitudinal positioning assemblies 80 and a bending member 90.

The body 20 includes a gripping portion 21, a support portion 23 formed at one end of an outer surface of the body 20, and a drive member 24 disposed inside the body 20. In the body 20 is formed an engaging groove 22. The support portion 23 is formed with a lock hole 230. The drive member 24 is provided at one end thereof with a toothed portion 240. A reciprocating member 241 has one end connected to the drive member 24 and another end engaged in the engaging groove 22, so that the drive member 24 can be pushed back to its original position automatically after being pressed.

The movable member 30 is disposed in the body 20 and provided with a movable groove 31, a rack 32 and an assembling portion 33. In the movable groove 31 is formed a fixing hole 310. An elastic member 34 is fixed in the fixing hole 310 by a fastener T in such a manner that two ends of the elastic member 34 are fixed to the fixing hole 310 of the movable groove 31 and a restricting portion 25 formed on an inner surface of the body 20. On the assembling portion 33 is formed an assembling hole 330.

The return member 40 is pivoted to the interior of the body 20 and provided with a pull portion 41 and an engaging tooth 42 which are located at two ends of the return member 40, respectively. The pull portion 41 is exposed out of the body 20, and the engaging tooth 42 is engaged with the rack 32 of the movable member 30 to allow the return member 40 pivot in a unidirectional manner.

The stationary member 50 is provided with a lock hole 51 aligned with the lock hole 230 of the support portion 23, then a fastener T2 is inserted in the lock holes 230, 51 to fix the stationary member 50 to the support portion 23 of the body 20. The stationary member 50 is provided with a plurality of transverse holes 52, a plurality of longitudinal holes 53 and an indication portion 54 capable of indicating size and position.

The adjustment members 60 each include an insertion hole 61, a transverse hole 62, a longitudinal hole 63 and a rotary block 64. The adjustment members 60 are mounted at two ends of the stationary member 50 via the insertion hole 61. The transverse and longitudinal positioning assemblies 70, 80 are disposed in the transverse and longitudinal holes 62, 63, respectively. The rotary block 64 is fixed at the top of each of the adjustment members 60, and the rotary block 64 is formed with a pipe groove 640 for holding a pipe T1. The transverse holes 62, 52 of the adjustment member 60 and the stationary member 50 are located corresponding to the indication portion 54 of the stationary member 50.

The transverse positioning assemblies 70 each include a rod 71, a positioning element 73 (which can be a ball) and an elastic member 72 disposed between the rod 71 and the positioning element 73. The positioning element 73 is disposed in the transverse hole 62 of a corresponding one of the adjustment members 60, since the transverse hole 62 is located corresponding to the stationary member 50, the adjustment member 60 can be preliminarily positioned with respect to the stationary member 50.

The longitudinal positioning assemblies 80 each include a rotary member 81, a pull member 82, a first positioning unit 83 and a second positioning unit 84. The rotary member 81 is provided with a plurality of engaging recesses 810. The pull member 82 is formed with a gap 820 in which the rotary member 81 and the first positioning unit 83 are to be disposed. The rotary member 81 is pivoted to the gap 820 of the pull member 82.

The first positioning unit 83 is provided with an elastic member 830 connected to a positioning member 831 (can be a ball) which can be disposed in any of the engaging recesses 810. The second positioning unit 84 is provided with a tenon 840 connected to an elastic member 841 and disposed in the rotary member 81. The tenon 840 has one end disposed in the longitudinal hole 63 of a corresponding one of the adjustment members 60, so as to enable the adjustment member 60 to be further positioned with respect to the stationary member 50.

The pipe bending member 90 is provided with an insertion hole 91 for insertion of the assembling portion 33 of the movable member 30, and a pipe holding groove 92 to be aligned with the pipe groove 640 of the rotary block 64.

The movable member 30 is movably disposed in the body 20 and able to move back and forth. The elastic member 34 has two ends fixed in the movable groove 31 and the body 20, respectively. The drive member 24 is pivoted to the interior of the body 20, and has the toothed portion 240 engaged with the rack 32 of the movable member 30. The reciprocating member 241 has two ends engaged in the drive member 24 and the engaging groove 22 of the body 20, respectively.

The return member 40 is pivoted to the interior of the body 20 and has the engaging tooth 42 engaged with the rack 32 of the movable member 30, and the pull portion 41 is exposed out of the body 20. The stationary member 50 is fixed in the lock holes 230, 51 by the fastener T2, so that the stationary member 50 is fixed to the support portion 23 of the body 20 and arranged in a T-shaped manner with respect to the movable member 30. The adjustment members 60 are mounted at two ends of the stationary member 50, the transverse and longitudinal positioning assemblies 70, 80 are disposed in the transverse and longitudinal holes 52, 53 62, 63, respectively, so that the adjustment members 60 can be moved along or fixed with respect to the stationary member 50. The rotary block 64 is fixed at the top of each of the adjustment members 60, the pipe bending member 90 is sleeved onto the assembling portion 33 of the movable member 30 via the insertion hole 91, and then the pipe T1 is placed in the pipe holding groove 92 and the pipe groove 640.

Figure 4:
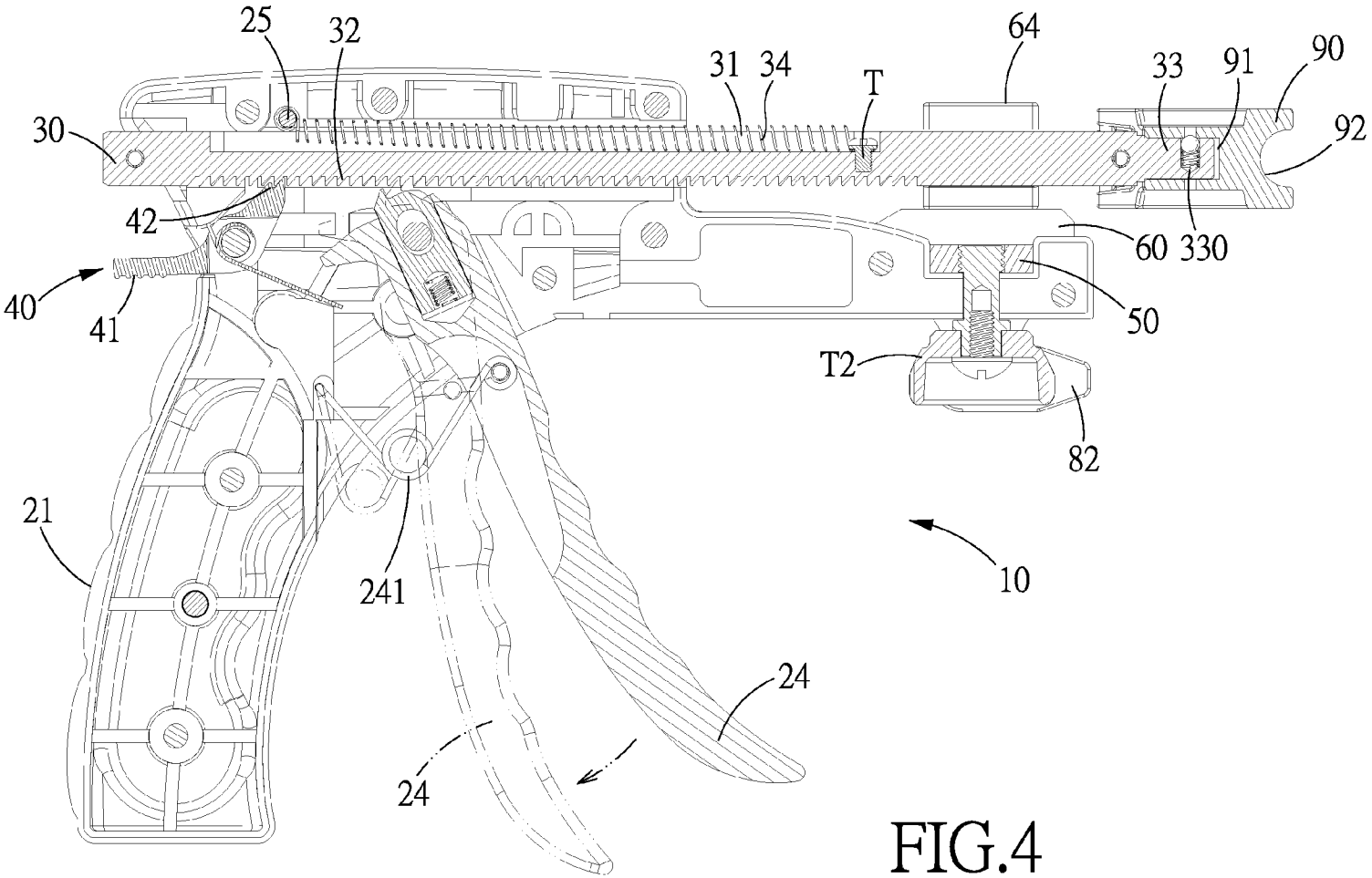
FIG. 4 is a cross sectional view of the pipe bender in accordance with the present invention.

Referring then to FIG. 4, when in use, the pipe T1 to be bent is placed in the pipe holding groove 92 of the pipe bending member 90 and the pipe groove 640 of the rotary block 64 (as shown in FIG. 3), then the user can hold the gripping portion 21 with one hand while pressing the drive member 24 repeatedly towards the gripping portion 21, so as to push the movable member 30 toward the stationary member 50 by virtue of the engagement of the toothed portion 240 of the drive member 24 with the rack 32 of the movable member 30. Since the stationary member 50 and the adjustment members 60 are fixed, keeping pressing the drive member 24 can make the movable member 30 keep pressing the pipe T1 until the pipe T1 is bent 90-180 degrees (as shown in FIG. 3). The elastic member 34 will be stretched when the movable member 30 is being pushed towards the stationary member 50.

Figure 5:
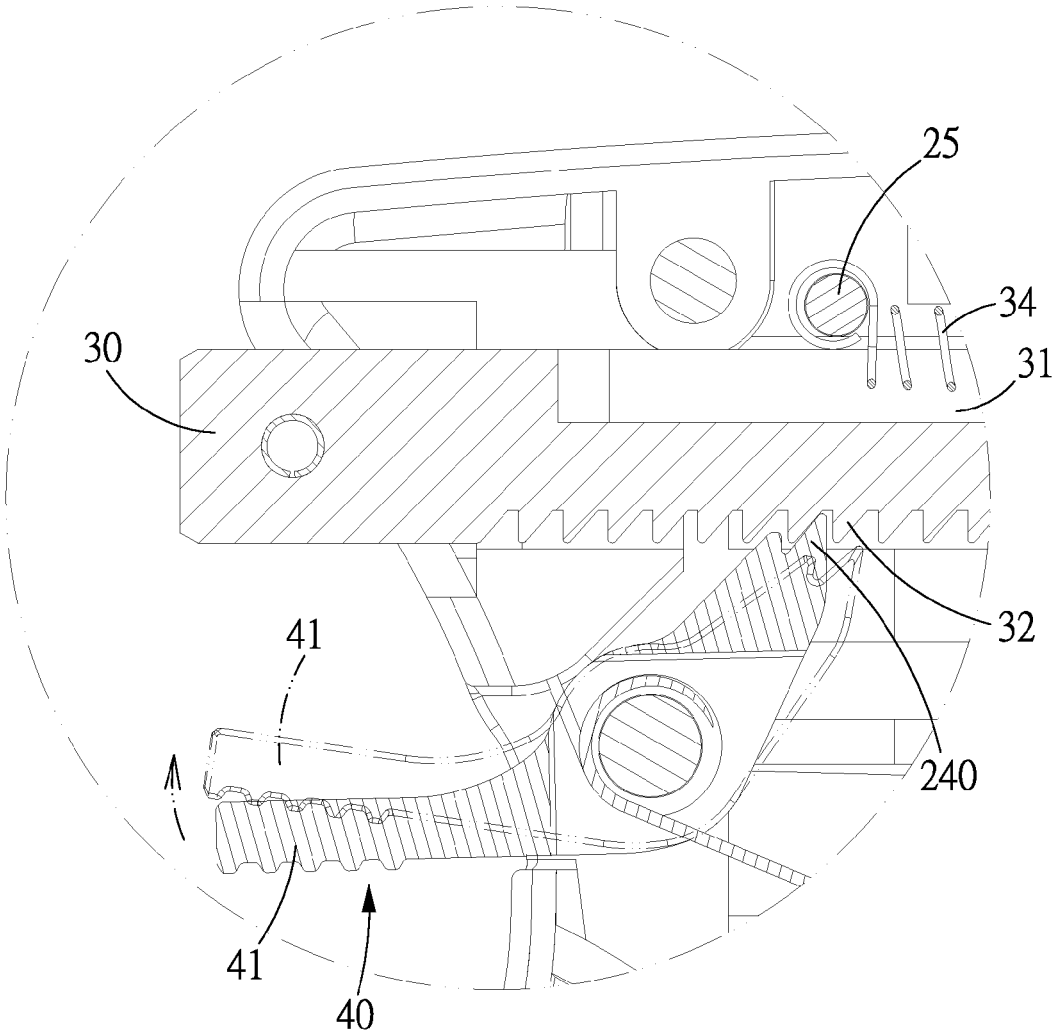
FIG. 5 is a second cross sectional view of the pipe bender in accordance with the present invention.
Figure 6:
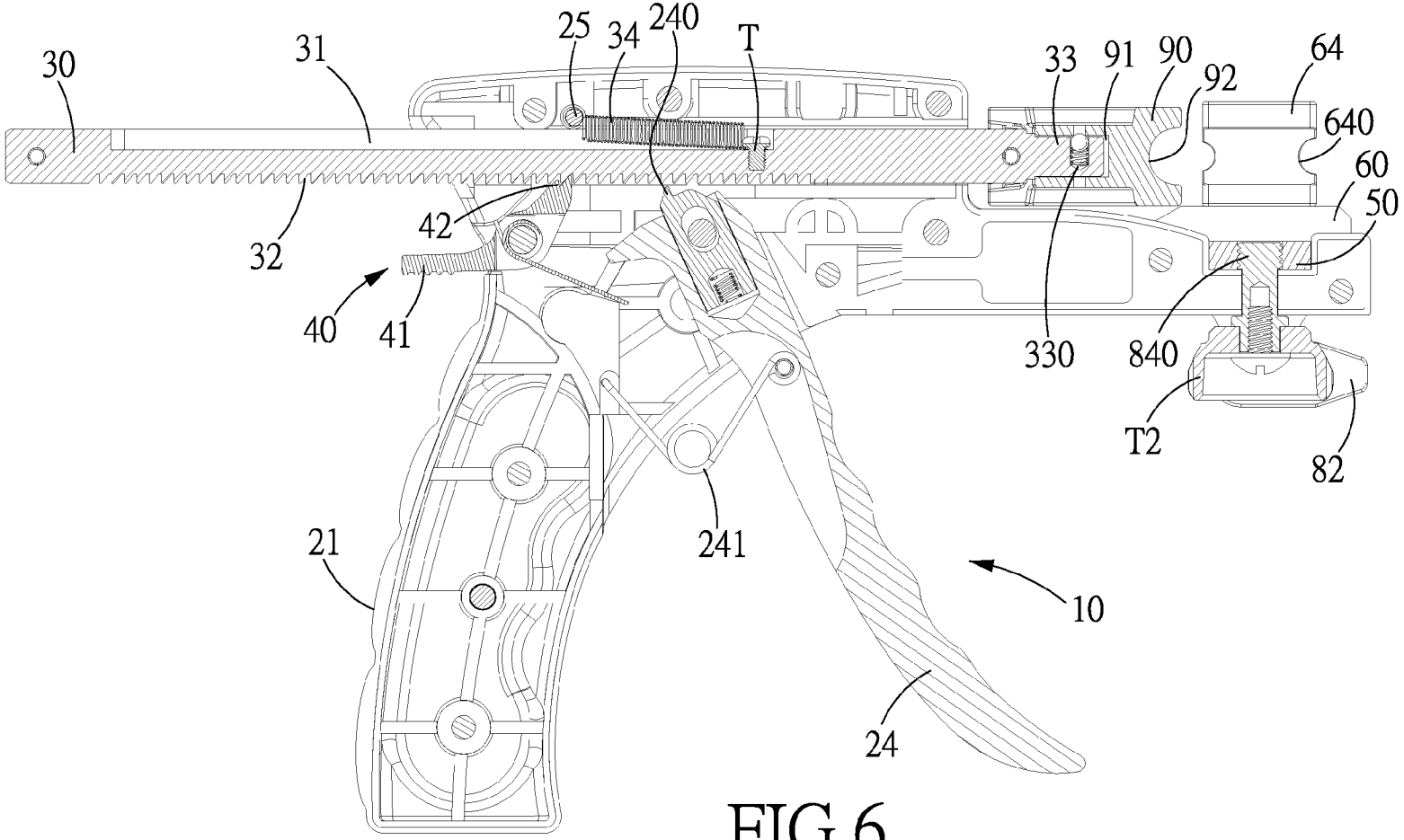
FIG. 6 is a third cross sectional view of the pipe bender in accordance with the present invention.

Referring then to FIGS. 5 and 6, after the bending of the pipe T1 is finished, the user can pull the pull portion 41 of the return member 40 to disengage the engaging tooth 42 from the rack 32, so that the movable member 30 will be pulled back to its original position by the elastic member 34.

Figure 7:
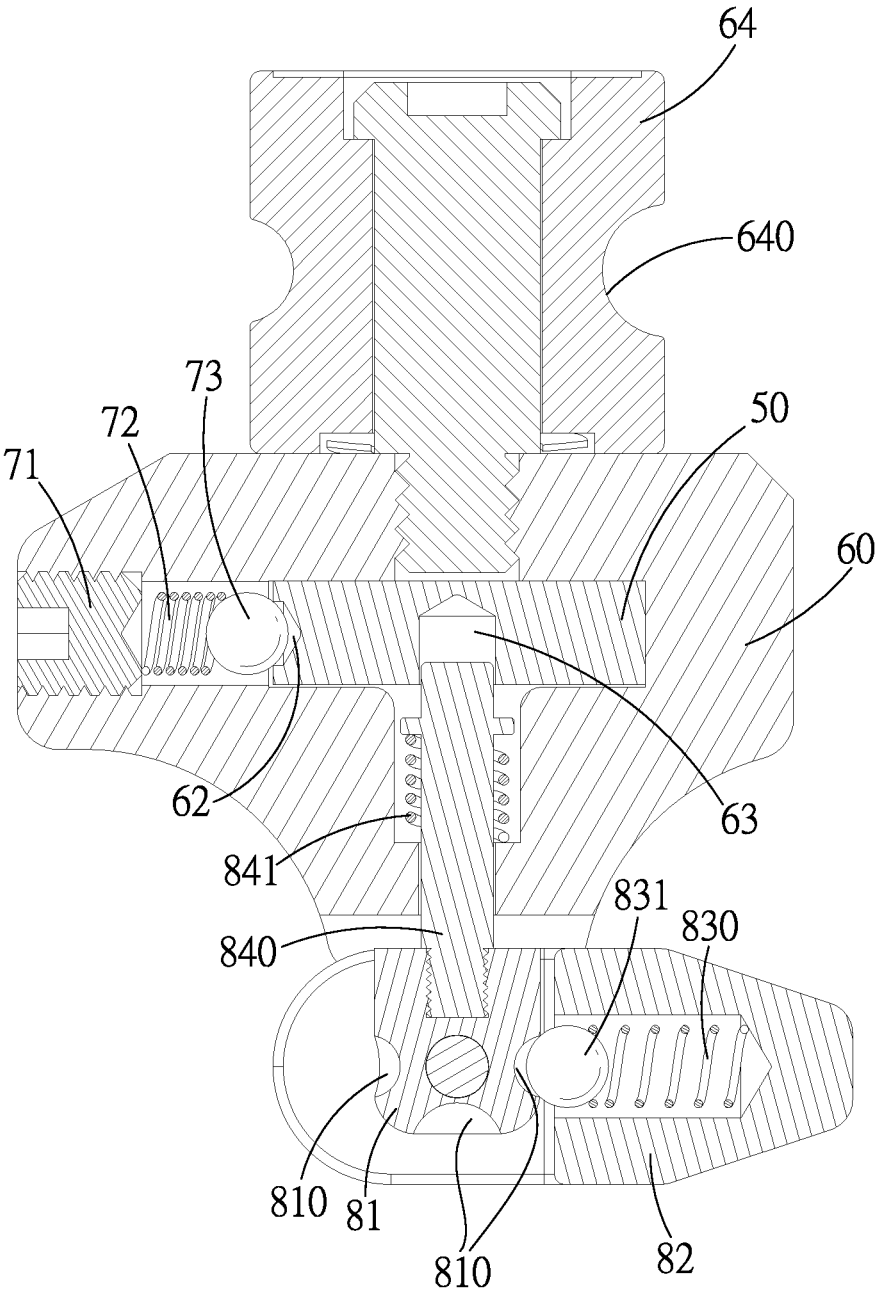
FIG. 7 is an operational view of the pipe bender in accordance with the present invention.
Figure 8:
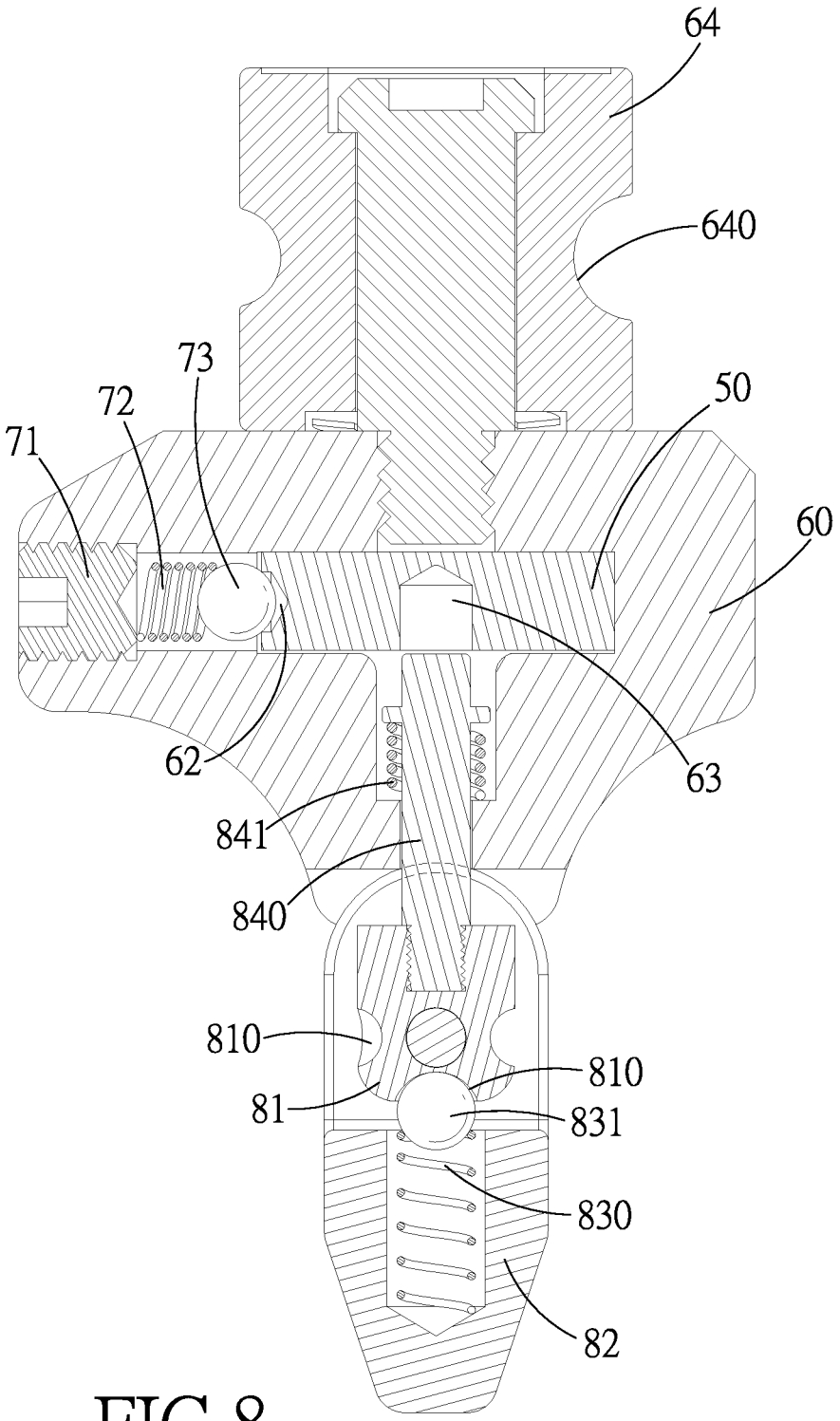
FIG. 8 is another operational view of the pipe bender in accordance with the present invention.

Referring then to FIGS. 7 and 8, the distance between the two adjustment members 60 should be adjustable to fit different sized pipe T1, and during the adjustment of the distance, the transverse and longitudinal positioning assemblies 70, 80 can provide positioning assistance. The pivoting connection of the rotary member 81 and the pull member 82 allows the pull member 82 to be pulled downward, the positioning member 831 of the first positioning unit 83 is disposed in one of the engaging recesses 810 which are located at the lateral surface of the rotary member 81, and the tenon 840 of the second positioning unit 84 is screwed to the rotary member 81, so that pushing the pull member 82 downward can rotate the rotary member 81, and can make the tenon 840 move downward and move out of the longitudinal hole 63 of the corresponding adjustment member 60. Meanwhile, the positioning member 831 of the first positioning unit 83 will move into the corresponding engaging recess 810 which is located at the bottom surface of the rotary member 81. Therefore, the user can adjust the positions of the adjustment members 60 when the tenon 840 is disengaged from the longitudinal hole 63 of the adjustment member 60, and during the adjustment process, the positioning member 73 of the transverse positioning assembly 70 will be pushed out of the transverse hole 62 of the adjustment member 60 by the stationary member 50.

When the distance adjustment is finished, the user can pull upward the pull member 82, so that the positioning member 831 of the first positioning unit 83 will be pushed into the engaging recesses 810 in the lateral surface of the rotary member 81 by the elastic member 830, and the tenon 840 of the second positioning unit 84 will be pushed by the elastic member 841 into the longitudinal hole 63 of the adjustment member 60. Meanwhile, the positioning member 73 of the corresponding one of transverse positioning assemblies 70 will be pushed back into the transverse hole 62 by the elastic member 72.

Since the transverse holes 62, 52 of the adjustment member 60 and the stationary member 50 are located corresponding to the indication portion 54 of the stationary member 50, with the cooperation of the positioning member 73 of the transverse positioning assembly 70 and the indication portion 54 of the stationary member 50, the adjustment member 60 can be preliminarily positioned with respect to the stationary member 50.

Figure 9:
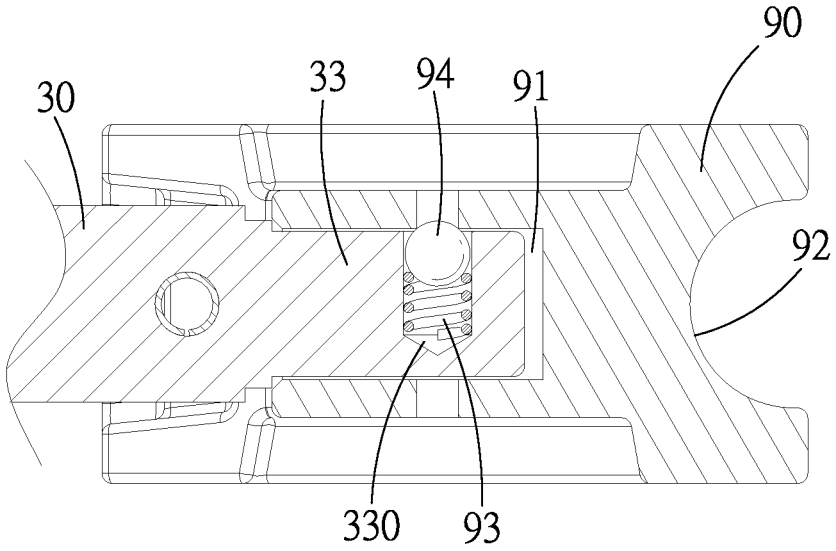
FIG. 9 is another operational view of the pipe bender in accordance with the present invention.

Referring then to FIG. 9, the pipe T1 to be bent may have different sizes, therefore, the pipe bending member 90 must be replaceable, and the diameter of the pipe holding groove 92 of the pipe bending member 90 must be equal to that of the pipe groove 640 of the rotary block 64. Inside the pipe bending member 90 are disposed an elastic member 93 and a restricting member 94 which are also disposed in the assembling hole 330 of the assembling portion 33, and the restricting member 94 projects partially out of the assembling hole 330, so that the pipe bending member 90 is restricted. The pipe bending member 90 can be pulled out with little force when it needs to be replaced. The restricting member 94 is pushed toward by the pipe bending member 90 to push the elastic member 93, when the restricting member 94 is pressed into the assembling hole 330, the pipe bending member 90 can be released from the assembling portion 33 of the movable member 30. To assemble the pipe bending member 90 onto the movable member 30, the assembling portion 33 of the movable member 30 can be inserted into the insertion hole 91 of the pipe bending member 90, then the restricting member 94 will be pushed by the elastic member 93 and will partially project out of the assembling hole 330, so that quick assembling and disassembling of the pipe bending member 90 is achieved. In other words, the restricting member 94 enables the pipe bending member 90 to be assembled to or disassembled from the movable member 30, and can be partially pushed out of or back into the assembling hole 330, which makes the assembling or disassembling of the pipe bending member 90 more easier.

The pipe bender 10 of the present invention has the following merits:

Firstly, the distance between the two adjustment members 60 is adjustable to fit different sized pipes, and with the cooperation of the positioning member 73 of the transverse positioning assembly 70 and the indication portion 54 of the stationary member 50, the adjustment member 60 can be preliminarily positioned with respect to the stationary member 50.

On the other hand, the user can hold the pipe bender 10 with one hand gripping the gripping portion 21, the return member 40 is located at the rear of the body 20 and adjacent to the gripping portion 21, when bending of the pipe is finished, the user can repeatedly press the return member 40 with easy to return the movable member 30 back to its original position.

Furthermore, the pipe bending member 90 is replaceable to fit different sized pipes, and the elastic member 93 enables the restricting member 94 to be partially pushed out of or back into the assembling hole 330, which makes the assembling or disassembling of the pipe bending member 90 more easier.

Finally, the rack 32 of the movable member 30 has a relatively long length to increase the travel length of the movable member 30, so that the pipe can be bent 90 or 180 degrees.

While we have shown and described various embodiments in accordance with the present invention, it is clear to those skilled in the art that further embodiments may be made without departing from the scope of the present invention.

What is claimed is:

1. A pipe bender comprising:

a body with a support portion formed on an outer surface of the body, and a drive member disposed inside the body;

a movable member provided with a movable groove, a rack and an assembling portion, in the movable groove being formed a fixing hole, in the assembling portion being formed an assembling hole, an elastic member having two ends fixed to the fixing hole of the movable groove and a restricting portion formed on an inner surface of the body, respectively;

a return member being provided with a pull portion and an engaging tooth which are located at two ends of the return member, respectively, the pull portion being exposed out of the body, and the engaging tooth being engaged with the rack of the movable member to allow the return member pivot in a unidirectional manner;

a stationary member being fixed to the support portion of the body and provided with a plurality of transverse holes, a plurality of longitudinal holes and an indication portion;

two adjustment members each including an insertion hole, a transverse hole, and a longitudinal hole, and being mounted at two ends of the stationary member via the insertion hole, two transverse positioning assemblies and two longitudinal positioning assemblies, being disposed in the transverse and longitudinal holes, respectively; and a pipe bending member assembled to the movable member and provided with a pipe holding groove, inside the pipe bending member being disposed an elastic member and a restricting member which are also disposed in the assembling hole of the assembling portion.

2. The pipe bender as claimed in claim 1, wherein the body includes a gripping portion and an engaging groove, and a reciprocating member has one end connected to the drive member and another end engaged in the engaging groove.

3. The pipe bender as claimed in claim 1, wherein the drive member is provided at one end thereof with a toothed portion for engaging with the rack of the movable member.

4. The pipe bender as claimed in claim 1, wherein the stationary member is provided with a lock hole aligned with a lock hole of the support portion, then a fastener is inserted in the lock holes to fix the stationary member to the support portion of the body.

5. The pipe bender as claimed in claim 1, wherein The pipe bending member is provided with an insertion hole for insertion of the assembling portion of the movable member, and a pipe holding groove.

6. The pipe bender as claimed in claim 1, wherein a rotary block is fixed at the top of each of the adjustment members, and formed with a pipe groove.

7. The pipe bender as claimed in claim 1, wherein the transverse positioning assemblies each include a rod, a positioning element and an elastic member disposed between the rod and the positioning element, the positioning element is disposed in the transverse hole of a corresponding one of the adjustment members.

8. The pipe bender as claimed in claim 1, wherein the longitudinal positioning assemblies each include a rotary member, a pull member, a first positioning unit and a second positioning unit.

9. The pipe bender as claimed in claim 1, wherein the transverse holes of the adjustment members and the stationary member are located corresponding to the indication portion of the stationary member.

10. The pipe bender as claimed in claim 8, wherein the rotary member is provided with a plurality of engaging recesses, and the pull member is formed with a gap.

11. The pipe bender as claimed in claim 8, wherein the first positioning unit is provided with an elastic member connected to a positioning member.

12. The pipe bender as claimed in claim 8, wherein the second positioning unit is provided with a tenon connected to an elastic member.

* * * * *